US005542248A

United States Patent [19]

Iwata et al.

[11] Patent Number: 5,542,248

[45] Date of Patent: Aug. 6, 1996

[54] AIR-FUEL RATIO CONTROL SYSTEM FOR INTERNAL COMBUSTION ENGINES

[75] Inventors: Yoichi Iwata; Yoshiharu Ave, both of Wako; Takayoshi Nakayama, Tochigi-ken, all of Japan

[73] Assignee: Honda Giken Kogyo Kabushiki Kaisha, Tokyo, Japan

[21] Appl. No.: 338,768

[22] Filed: Nov. 10, 1994

[30] Foreign Application Priority Data

Nov. 11, 1993 [JP] Japan ..... 5-305889

[51] Int. Cl.[6] ..... F01N 3/20

[52] U.S. Cl. ..... 60/276; 60/277; 60/285

[58] Field of Search ..... 60/276, 277, 285

[56] References Cited

U.S. PATENT DOCUMENTS

| | | | |
|---|---|---|---|
| 5,280,707 | 1/1994 | Nakashima | 60/277 |
| 5,325,664 | 7/1994 | Seki | 60/277 |
| 5,363,647 | 11/1994 | Ohuchi | 60/276 |

FOREIGN PATENT DOCUMENTS 62-147034 7/1987 Japan .

*Primary Examiner*—Douglas Hart

*Attorney, Agent, or Firm*—Nikaido, Marmelstein, Murray & Oram LLP

[57] ABSTRACT

There is provided an air-fuel ratio control system for controlling the air-fuel ratio of a mixture supplied to an internal combustion engine having an exhaust passage. The system includes upstream and downstream exhaust gas component concentration sensors arranged in the exhaust passage at respective locations upstream and downstream of a catalytic converter, for detecting concentration of a component contained in exhaust gases. Feedback control of the air-fuel ratio of the mixture is carried out based on a value of a control parameter set based on an output from the downstream exhaust gas component concentration sensor and an output from the upstream exhaust gas component concentration sensor. An inversion period is detected with which the output from the upstream exhaust gas component concentration sensor is inverted from one side to another side with respect to a predetermined level during the feedback control of the air-fuel ratio. It is determined whether or not one of the output from the downstream exhaust gas component concentration sensor and the value of the control parameter falls within a predetermined range. It is determined whether or not the inversion period is within a predetermined time period. Then, deterioration of the upstream exhaust gas component concentration sensor is determined based on results of these determinations.

8 Claims, 11 Drawing Sheets

INTERNAL COMBUSTION ENGINE
THREE-WAY CATALYST
TCAT
O2
O2
CRK
NE
TW
TA
PBA
θ TH
VH
LED
INPUT CIRCUIT
C P U
MEMORY MEANS
OUTPUT CIRCUIT
ECU
1
2
3
4
5
5a
5b
5c
5d
6
7
8
9
10
11
12
13
14F
14R
15
21
46

CALCULATION OF KO2
DETERMINATION OF VREFF
S201
RETRIEVAL OF F/B GAINS
S202
S203
VO2 INVERTED ?
NO
YES
S205
VO2F<VREFF ?
NO
YES
S204
VO2F<VREFF ?
NO
YES
S230
S225
KO2←KO2−I
KO2← KO2+(PR×KP)
KO2← KO2 −(PL×KP)
S221
S215
LIMIT-CHECK KO2
S216
KO2←KO2+I
CALCULATE KREF
S217
KREF-CHECK KREF
S218
RETURN

DETERMINATION OF VREFF
S311
READ IN VO2R
S311A
CALCULATE WEIGHTED MEAN OF VO2R
S312
RETRIEVE VREFF TABLE BY VO2R
S313
VREFF≧ VREFFLMTH?
YES
NO
S317
VREFF← VREFFLMTH
S316
VREFF≦ VREFFLMTL?
YES
NO
S318
VREFF← VREFFLMTL
S319
RESET TIMER
S314
CONTINUED LONGER THAN t1?
NO
YES
S315
S320
FLMTNG←0
FLMTNG←1
RETURN

DETERIORATION DETERMINATION BY VO2R
READ IN VO2R
S451
S452
VO2R≦ VO2LMTL?
YES
NO
S453
VO2R≧ VO2LMTH?
YES
NO
S454
FLMT←0
S455
FLMT=1?
YES
NO
S456
FLMT←1
SET DOWNCOUNTER
S457
S458
C=0?
YES
NO
C=C−1
S459
S460
FLMTNG←1
END

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for an internal combustion engine which is capable of detecting deterioration of an exhaust gas component concentration sensor arranged in an intake passage of the engine at a location upstream of a catalytic converter.

2. Prior Art

Conventionally, it is known to provide an upstream oxygen sensor and a downstream oxygen sensor as exhaust gas component concentration sensors (air-fuel ratio sensors) in an exhaust passage of an internal combustion engine at respective upstream and downstream locations of a catalytic converter, and perform air-fuel ratio feedback control based on an output from the upstream oxygen sensor while compensating for an error in the output by the use of an output from the downstream oxygen sensor, to thereby control a mixture supplied to the engine to a stoichiometric air-fuel ratio in a feedback manner.

To carry out such air-fuel ratio feedback control by the use of two oxygen sensors arranged at the respective upstream and downstream locations of a catalytic converter there has been proposed an air-fuel ratio control system by Japanese Provisional Patent Publication (Kokai) No. 62-147034, which changes one of a plurality of control amounts, such as a skip amount (proportional term) of an air-fuel ratio correction efficient KO2, a delay time before generation of the skip amount after an output from the upstream oxygen sensor has been inverted from a richer side to a leaner side or vice versa with respect to a stoichiometric air-fuel ratio, an integral term of the air-fuel ratio correction coefficient KO2, and a reference value for comparison with the output from the upstream oxygen sensor, depending on an output from the downstream oxygen sensor. When any of these control amount, i.e., skip amount, delay time, and reference value, thus changed, reaches its limit value, it is determined that the upstream oxygen sensor is deteriorated, whereby an alarm is given.

According to the above proposed air-fuel ratio control system, however, it is impossible to determine what kind of deterioration the upstream oxygen sensor is suffering from. That is, it is impossible to determine whether the deterioration of the upstream oxygen sensor is caused by deviation of a rich/lean turning point of the output from the upstream oxygen sensor from a point corresponding to the stoichiometric air-fuel ratio, or a delay in response of the oxygen sensor.

SUMMARY OF THE INVENTION

It is the object of the invention to provide an air-fuel ratio control system for an internal combustion engine, which is capable of determining a kind of deterioration of an upstream exhaust gas component concentration sensor arranged in an exhaust passage of the engine at a location upstream of a catalytic converter.

To attain the above object, the present invention provides an air-fuel ratio control system for controlling an air-fuel ratio of a mixture supplied to an internal combustion engine having an exhaust passage, comprising:

a catalytic converter arranged in the exhaust passage for purifying noxious components contained in exhaust gases from the engine;

an upstream exhaust gas component concentration sensor arranged in the exhaust passage at a location upstream of the catalytic converter for detecting concentration of a component contained in the exhaust gases;

a downstream exhaust gas component concentration sensor arranged in the exhaust passage at a location downstream of the catalytic converter for detecting concentration of the component contained in the exhaust gases;

control parameter-setting means for setting a value of a control parameter for use in controlling the air-fuel ratio of the mixture, based on an output from the downstream exhaust gas component concentration sensor;

feedback control means for carrying out feedback control of the air-fuel ratio of the mixture, based on the value of the control parameter set by the control parameter-setting means and an output from the upstream exhaust gas component concentration sensor;

inversion period-detecting means for detecting an inversion period with which the output from the upstream exhaust gas component concentration sensor is inverted from one side to another side and/or from the another side to the one side with respect to a predetermined level during the feedback control of the air-fuel ratio by the feed back control means;

first determining means for determining whether or not one of the output from the downstream exhaust gas component concentration sensor and the value of the control parameter set by the control parameter-setting means falls within a predetermined range;

second determining means for determining whether or not the inversion period detected by the inversion period-detecting means falls within a predetermined time period; and deterioration-determining means for determining deterioration of the upstream exhaust gas component concentration sensor, based on results of determinations by the first determining means and the second determining means.

Preferably, the deterioration-determining means determines that the upstream exhaust gas component concentration sensor suffers from a deterioration of a delay in response, when the first determining means determines that the one of the output from the downstream exhaust gas component concentration sensor and the value of the control parameter falls within the predetermined range, and at the same time the second determining means determines that the inversion period is longer than the predetermined time period.

Also preferably, the deterioration-determining means determines that the upstream exhaust gas component concentration sensor suffers from a deterioration that a point of inversion of the output from the upstream exhaust gas component concentration sensor deviates from a point corresponding to a stoichiometric air-fuel ratio, when the first determining means determines that the one of the output from the downstream exhaust gas component concentration sensor and the value of the control parameter falls outside the predetermined range, and at the same time the second determining means determines that the inversion period falls within the predetermined time period.

More preferably, the first determining means includes time-measuring means for measuring a time period over which the one of the output from the upstream exhaust gas component concentration sensor and the value of the control parameter set by the control parameter-setting means continues to lie outside the predetermined range, and the deterioration-determining means determines that the upstream exhaust gas component concentration sensor suffers from the deterioration that the point of inversion of the output from the upstream exhaust gas component concentration sensor deviates from the point corresponding to the stoichiometric air-fuel ratio, when the time period measured by the time measuring means reaches a predetermined time period, and at the same time the second determining means determines that the inversion period falls within the predetermined time period.

Further preferably, the control parameter is a reference value used in the feedback control of the air-fuel ratio for comparison with the output from the upstream exhaust gas component concentration sensor.

Alternatively, the control parameter is a proportional term used in the feedback control of the air-fuel ratio.

More preferably, the control parameter-setting means includes reference value-setting means for setting a reference value used in the feedback control of the air-fuel ratio for comparison with the output from the upstream exhaust gas component concentration sensor, based on the output from the downstream exhaust gas component concentration sensor, time-measuring means for measuring a time period over which the reference value falls outside a predetermined range, and changing means for incrementing or decrementing the proportional term by a predetermined value whenever the time period measured by the time-measuring means reaches a predetermined time period.

The above and other objects, features and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
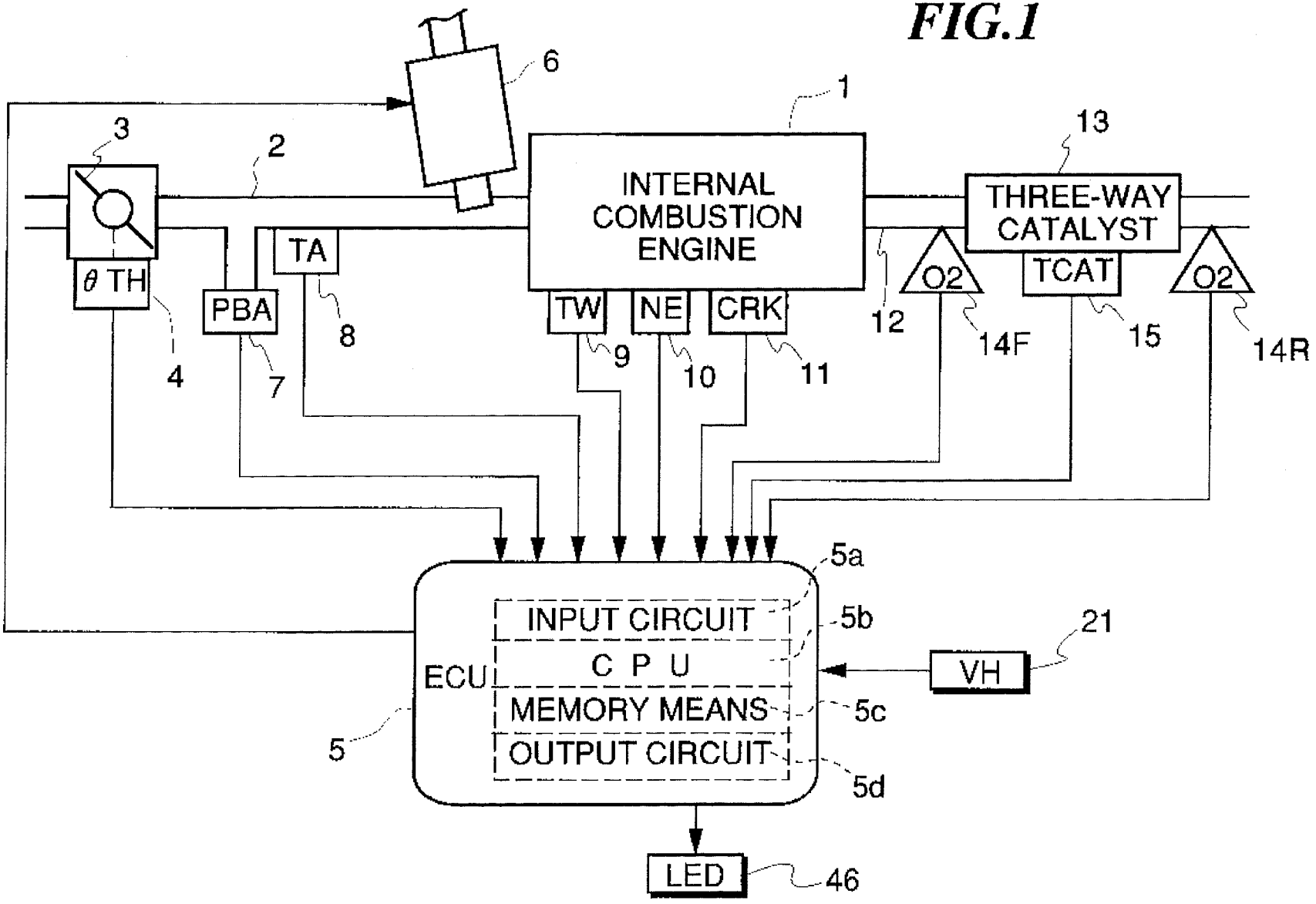
FIG. 1 is a block diagram showing the whole arrangement of an air-fuel ratio control system incorporated in an internal combustion engine, according to a first embodiment of the invention.

Referring first to FIG. 1, there is shown the whole arrangement of an air-fuel ratio control system incorporated in an internal combustion engine, according to a first embodiment of the invention. In the figure, reference numeral 1 designates an internal combustion engine which is a four-cylinder type, for example (hereinafter simply referred to as "the engine"). In an intake pipe 2 of the engine, there is arranged a throttle valve 3. A throttle valve opening (θTH) sensor 4 is connected to the throttle valve 3 for generating an electric signal indicative of the sensed throttle valve opening θTH and supplying same to an electronic control unit (hereinafter referred to as the ECU") 5.

Fuel injection valves 6 are each provided for each cylinder and arranged in the intake pipe 2 between the engine 1 and the throttle valve 3, and at a location slightly upstream of intake valves, not shown. The fuel injection valves 6 are electrically connected to the ECU 5 to have their valve opening periods controlled by signals therefrom.

On the other hand, an intake pipe absolute pressure (PBA) sensor 7 is provided in communication with the interior of the intake pipe 2 via a branch conduit 17 at a location immediately downstream of the throttle valve 3, for sensing absolute pressure (PBA) within the intake pipe 2, and electrically connected to the ECU 5 for supplying an electric signal indicative of the sensed absolute pressure PBA to the ECU 5. Further, an intake air temperature (TA) sensor 8 is inserted into the intake pipe 2 at a location downstream of the intake pipe absolute pressure sensor 7 for supplying an electric signal indicative of the sensed intake air temperature TA to the ECU 5.

An engine coolant temperature sensor (TW) sensor 9, which may be formed of a thermistor or the like, is mounted in the coolant-filled cylinder block of the engine for supplying an electric signal indicative of the sensed engine coolant temperature TW to the ECU 5.

An engine rotational speed (NE) sensor 10 and a CRK sensor 11 are arranged in facing relation to a camshaft or a crankshaft of the engine 1, neither of which is shown. The NE sensor 10 generates a pulse as a TDC signal pulse at each of predetermined crank angles whenever the crankshaft rotates through 180 degrees, while the CRK sensor 11 generates a pulse as a CRK signal pulse whenever the crankshaft rotates through a predetermined angle, e.g., 30 degrees, both of the pulses being supplied to the ECU 5.

A catalytic converter (three-way catalyst as an exhaust gas-purifying device) 13 is arranged in an exhaust pipe 12 of the engine 1. An upstream O2 sensor 14F as an oxygen concentration sensor is arranged in the exhaust passage at a location upstream of the catalytic converter 13, while a downstream O2 sensor 14R is arranged in same at a location downstream of the catalytic converter 13. These O2 sensors detect concentration of oxygen contained in exhaust gases at respective locations and deliver electric signals (VO2F, VO2R) indicative of the sensed oxygen concentrations to the ECU 5. Further, an LED alarm 46 is connected to the ECU 5, which is comprised of a plurality of LED's (light-emitting diodes) which emit light in colors of red, green, and orange.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as the "CPU") 5*b*, memory means 5*c* storing various operational programs which are executed by the CPU 5*b*, and various maps, referred to hereinafter, and for storing results of calculations therefrom, etc., an output circuit 5*d* which outputs driving signals to the fuel injection valves 6, etc.

The CPU 5*b* determines various engine operating conditions, such as a feedback control region in which air-fuel ratio control should be carried out in a feedback manner according to the concentration of oxygen in exhaust gases sensed by the upstream and downstream O2 sensors 14F, 14R, referred to hereinafter, and a plurality of open-loop control regions in which air-fuel ratio control should be carried out in a non-feedback manner, based on engine operating parameters detected by the sensors described above, and calculates a fuel injection period TOUT over which each of the fuel injection valves 6 should be opened, in synchronism with generation of TDC signal pulses, by the use of Equation (1):

$$TOUT=Ti\times KO2\times K1\times K2 \quad (1)$$

where Ti represents a basic value of the fuel injection period TOUT, which is read from a Ti map according to the engine rotational speed NE and the intake pipe absolute pressure PBA. KO2 represents an air-fuel ratio correction coefficient which is determined in the feedback control region of the engine by a feedback control routine, described hereinafter, based on outputs from the O2 sensors 14F, 14R, and further, in the open-loop control regions of same, set to predetermined values dependent on the respective regions. K1 and K2 represent other correction coefficients and correction variables, respectively, which are determined according to operating parameters of the engine, and are set to such values as optimize engine operating characteristics, such as fuel consumption and engine accelerability.

The CPU 5*b* supplies the driving signals based on the fuel injection period TOUT thus determined via the output circuit 5*d* to the fuel injection valves 6 to open same over the fuel injection period TOUT.

Next, description will be made of the air-fuel ratio feedback control (hereinafter referred to as "the 2 O2 sensor F/B control) by the use of the upstream and downstream O2 sensors 14F, 14R.

Figure 2:
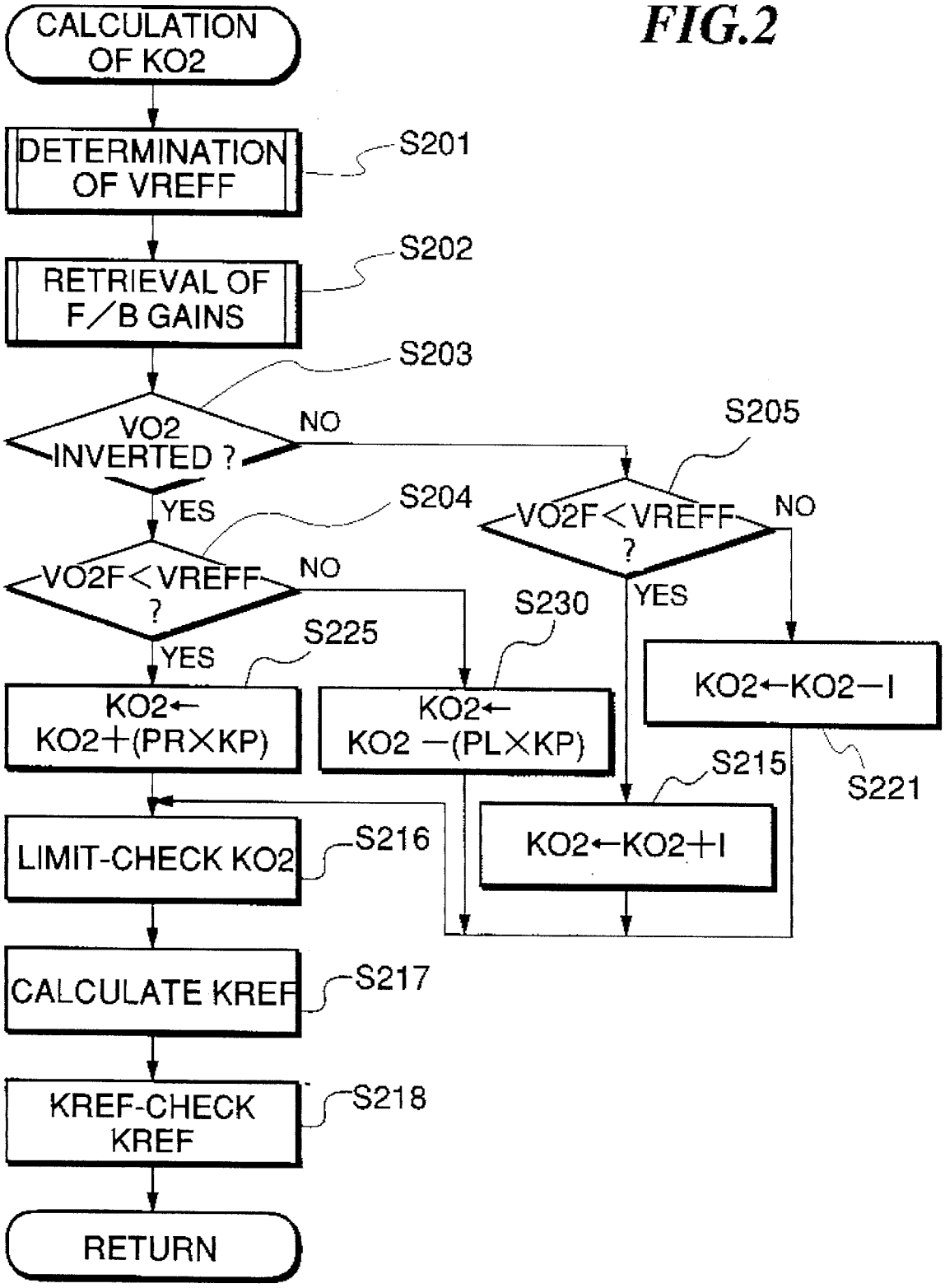
FIG. 2 is a flowchart showing a program for calculating an air-fuel ratio correction coefficient KO2.

FIG. 2 shows a KO2-calculating program for calculating an air-fuel ratio correction coefficient KO2 for use in the 2 O2 sensor F/B control. In the present embodiment, the air-fuel ratio of a mixture supplied to the engine is controlled to a stoichiometric air-fuel ratio (lambda=1) by calculating the air-fuel ratio correction coefficient KO2 based on the output VO2F from the upstream O2 sensor 14F and the output VO2R from the downstream O2 sensor 14R.

First, at a step S201, a reference value VREFF for comparison with the output VO2F from the upstream O2 sensor 14F is determined by a VREFF-calculating subroutine, described hereinafter. Then, at a step S202, feedback gains for the air-fuel ratio feedback control based on the output VO2F from the upstream O2 sensor 14F are determined by a feedback gain-retrieving subroutine, described hereinafter.

Then, at a step S203, it is determined whether or not the output VO2F from the upstream O2 sensor 14F has been inverted from a leaner side to a richer side or vice versa with respect to the reference value VREFF. If the answer to this question is negative (NO), the program proceeds to a step S205, where it is further determined whether or not the output VO2F is lower than the reference value VREFF. If the answer to this question is affirmative (YES), i.e., if the former is lower than the latter, it is judged that the mixture supplied to the engine has continuously been lean, and then the program proceeds to a step S215.

At the step S215, the correction coefficient KO2 is updated by adding an integral term (I term) to the immediately preceding value thereof calculated in the immediately preceding loop, according to Equation (2):

$$KO2=KO2+I \quad (2)$$

Following the step S215, limit checking of the KO2 value is carried in a known manner at a step S216, and then a learned value KREF of the reference value VREFF is calculated at a step S217. Then, limit checking of the KREF value is carried out at the following step S218 in a known manner, followed by terminating the program.

If the answer to the question of the step S205 is negative (NO), i.e., if the output VO2F from the upstream O2 sensor is equal to or higher than the reference value VREFF, it is judged that the mixture supplied to the engine has continuously been rich, and then the program proceeds to a step S221.

At the step S221, the correction coefficient KO2 is updated by subtracting the I term from the immediately preceding value thereof according to Equation (3):

$$KO2=KO2-I \quad (3)$$

Then, the steps S216 to 218 are executed, followed by terminating the present program.

If the answer to the question to the step S203 is affirmative (YES), i.e., if it is determined that the output VO2F from the upstream O2 sensor has been inverted with respect to the reference value VREFF, it is further determined at a step S204 whether or not the output VO2F is lower than the reference value VREFF. If the output VOF2 is lower than the reference value VREFF, it is judged that the output VO2F has been inverted from the richer side to the leaner side, and then the program proceeds to a step S225. is updated by adding the product of a proportional term PR and a coefficient KP to the immediately preceding value of the correction coefficient KO2 according to Equation (4):

$$KO2=KO2+(PR\times KP) \quad (4)$$

where KO2 on the right side represents the immediately preceding value of the correction coefficient KO2, and the term PR is a correction term for shifting the air-fuel ratio toward the richer side with respect to the stoichiometric air-fuel ratio by stepwise increasing the correction coefficient KO2 upon inversion of the output VO2F of the upstream O2 sensor 14F from the richer side to the leaner side. The coefficient KP is set at a step S502 or S503 in FIG. 5, referred to hereinafter, depending on operating conditions of the engine.

Then, the steps S216 to S218 are executed, followed by terminating the program. If the answer to the question of the step S204 is negative (NO), i.e., if it is determined that the output VO2F is equal to or higher than the reference value VREFF, it is judged that the output VO2F has been inverted from the leaner side to the richer side, and then the program proceeds to a step S230

At the step S230, the correction coefficient KO2 is updated by subtracting the product of a proportional term PL and the coefficient KP from the immediately preceding value of the correction coefficient KO2 according to Equation (5):

$$KO2=KO2+(PL\times KP) \quad (5)$$

where KO2 on the right side represents the immediately preceding value of the correction coefficient KO2, and the proportional term PL is a correction term for shifting the air-fuel ratio toward the leaner side with respect to the stoichiometric air-fuel ratio by stepwise decreasing the correction coefficient KO2 upon inversion of the output VO2F of the upstream O2 sensor 14F from the leaner side to the richer side.

Then, the steps S216 to S218 are executed, followed by terminating the program.

As described heretofore, the air-fuel ratio correction coefficient KO2 is calculated based on the output VO2F from the upstream O2 sensor 14F. The learned value KREF calculated at the step S217 is set as an initial value of the correction coefficient KO2 at the start of the air-fuel ratio feedback control, for instance.

Figure 3:
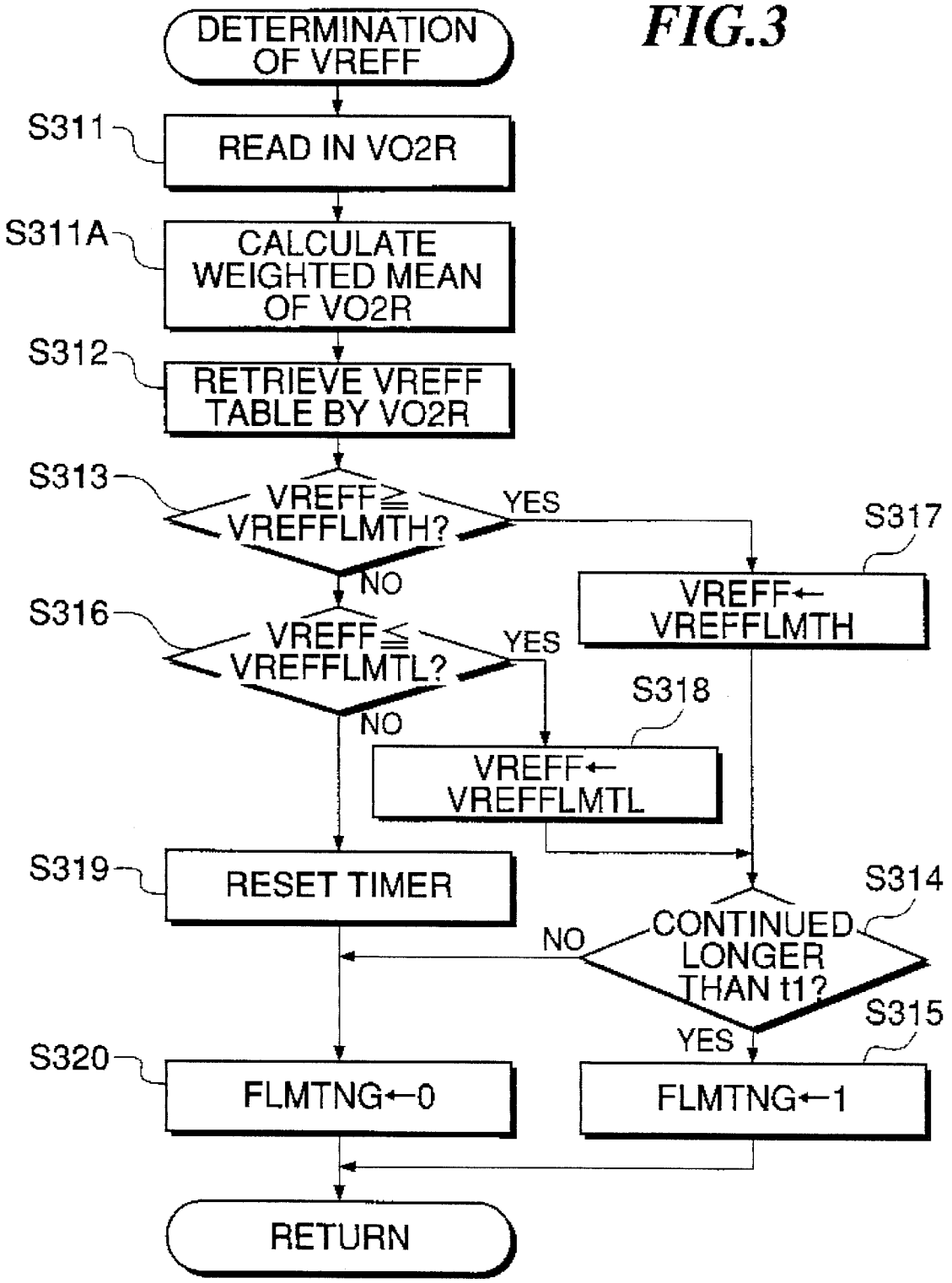
FIG. 3 is a flowchart showing a VREFF-determining routine executed by the first embodiment for determining a reverence value VREFF.

Next, the manner of calculation of the reference value VREFF executed at the step S201 of the FIG. 2 program will be described in detail with reference to FIG. 3 showing the VREFF-calculating subroutine.

First, the present value of the output VO2R from the downstream O2 sensor 14R is read in at a step S311. At the following step S311A, a weighted average value of the output VO2R is calculated from the value VO2R read, and the weighted average value obtained is used at the following step S312 for determining the reference value VREFF for the upstream O2 sensor 14F from a VREFF table, not shown. The reference value VREFF thus determined is used for comparison with the output VO2F from the upstream O2 sensor 14F at the step S204 in the main routine for calculation of the air-fuel ratio coefficient KO2.

Then, at the following steps, whether or not the upstream O2 sensor 14F is deteriorated is determined by the use of the reference value VREFF determined at the step S312. That is, it is determined at a step S313 whether or not the reference value VREFF is equal to or higher than a predetermine upper limit value VREFFLMTH. If the answer to this question is affirmative (YES), the reference value VREFF is set to the predetermined upper limit value VREFFLMTH at a step S317. Further, it is determined at a step S314 whether or not this condition has continued longer than a predetermined time period t1. If the answer to this question is affirmative (YES), a flag FLMTNG is set to a value of 1 at a step S315 for indication of deterioration of the upstream O2 sensor 14F, followed by terminating the routine. If the answer to the question of the step S314 is negative (NO), the program proceeds to a step S320, where the flag FLMTNG is set to a value of 0, followed by terminating the routine.

On the other hand, if the answer to the question of the step S313 is negative (NO), i.e., if the reference valve VREFF is lower than the predetermined upper limit value VREFFLMTH, it is further determined at a step S316 whether or not the reference value VREFF is equal to or lower than a predetermine lower limit value VREFFLMTL. If the answer to this question is affirmative (YES), the reference value VREFF is set to the predetermined lower limit value VREFFLMTL at a step S318, and then the program proceeds to the step S314. If the answer to the question of the step S316 is negative (NO), i.e., if it is determined that VREFFLMH< VREFF<VREFFLML, the program proceeds to a step S319, where a timer for measuring the time period t1 is reset, followed by the program proceeding to the step S320.

Figure 4:
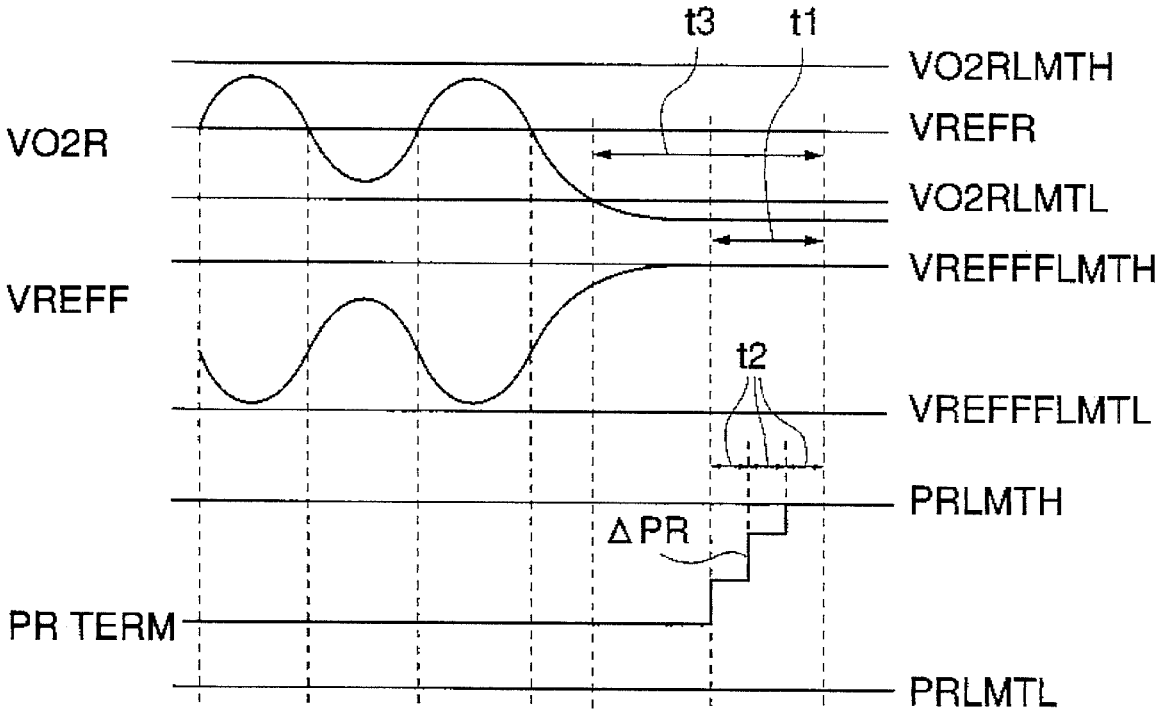
FIG. 4 is a waveform diagram showing a waveform of an output VO2 from a downstream O2 sensor and a waveform of the reference value VREFF for the upstream O2 sensor calculated by the VREFF-determining routine.

FIG. 4 shows waveforms indicative of changes in the value of the output VO2R from the downstream O2 sensor 14R, the reference value VREFF for the upstream O2 sensor 14F calculated by the VREFF-calculating subroutine described above, and the proportional term PR for use in changing the air-fuel ratio in the enriching direction. As shown in the figure, when the reference value VREFF for the upstream O2 sensor has continuously been set to the predetermined higher limit value VREFFLMTH over the predetermined time period t1, the flag FLMTNG is set to the value of 1. Further, the values VO2R, VREFF, and PR are in such a relationship that over the time period t1, the proportional term PR is incremented by ΔPR every time period t2 until it reaches a predetermined upper limit value PRLMTH, while at this time point the output VO2R has continued to be lower than a lower limit value VO2RLMTL over a predetermined time period t3.

Figure 5:
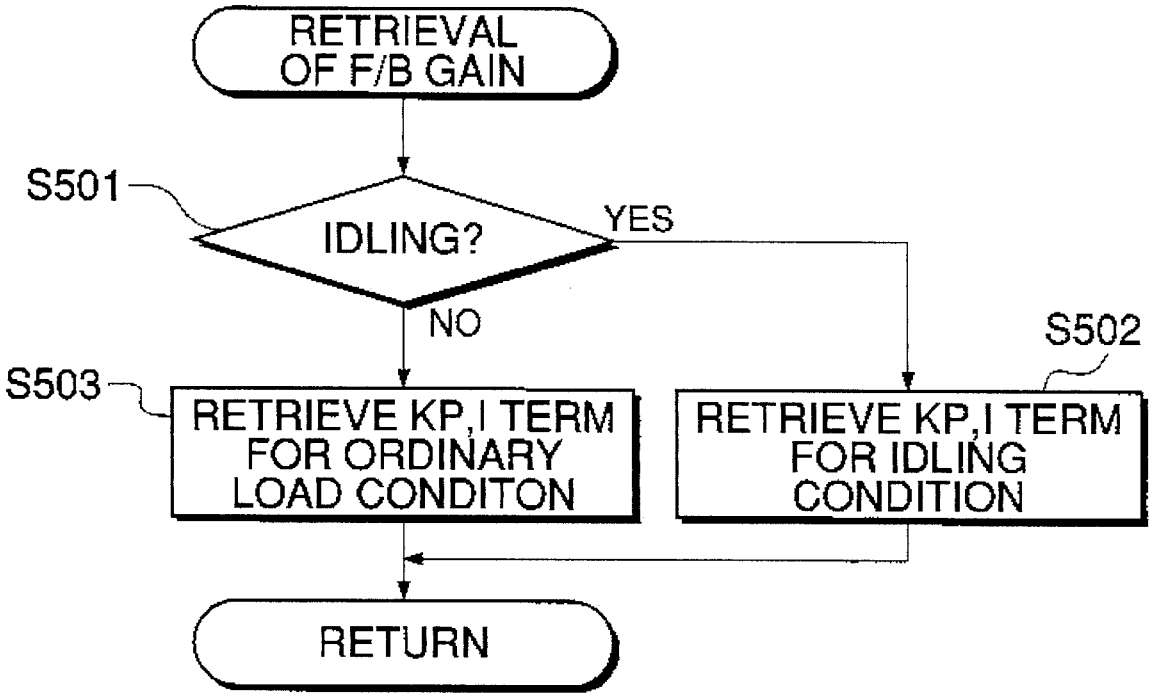
FIG. 5 is a flowchart showing an F/B gain-retrieving subroutine for retrieving a feedback gain for use in the air-fuel ratio feedback control based on an output from the upstream O2 sensor.

Next, the manner of retrieval of the feedback gains in the air-fuel ratio feedback control based on the upstream O2 sensor 14F, which is executed at the step S202 of the KO2-calculating program shown in FIG. 2, will be described in detail with reference to FIG. 5 showing an F/B gain retrieving subroutine. The feedback gains are set to the optimum values by retrieving respective maps, not shown, according to the engine rotational speed NE and the intake pipe absolute pressure PBA.

First, at a step S501, it is determined whether or not the engine 1 is idling. If the answer to this question is affirmative (YES), the program proceeds to a step S502, where a value of the coefficient KP (coefficient for increasing or decreasing the P term (proportional term)) and a value of the I term (integral term) for idling are retrieved from a map for idling, not shown, followed by terminating the program. If the answer to the question of the step S401 is affirmative (YES), i.e., if the engine is in an ordinary loaded operating condition, the program proceeds to a step S403, where values of the coefficient KP and the I term (integral term) for the ordinary loaded condition are retrieved from a map for the ordinary loaded condition according to the engine rotational speed NE and the intake pipe absolute pressure PBA, not shown, followed by terminating the program.

Figure 6:
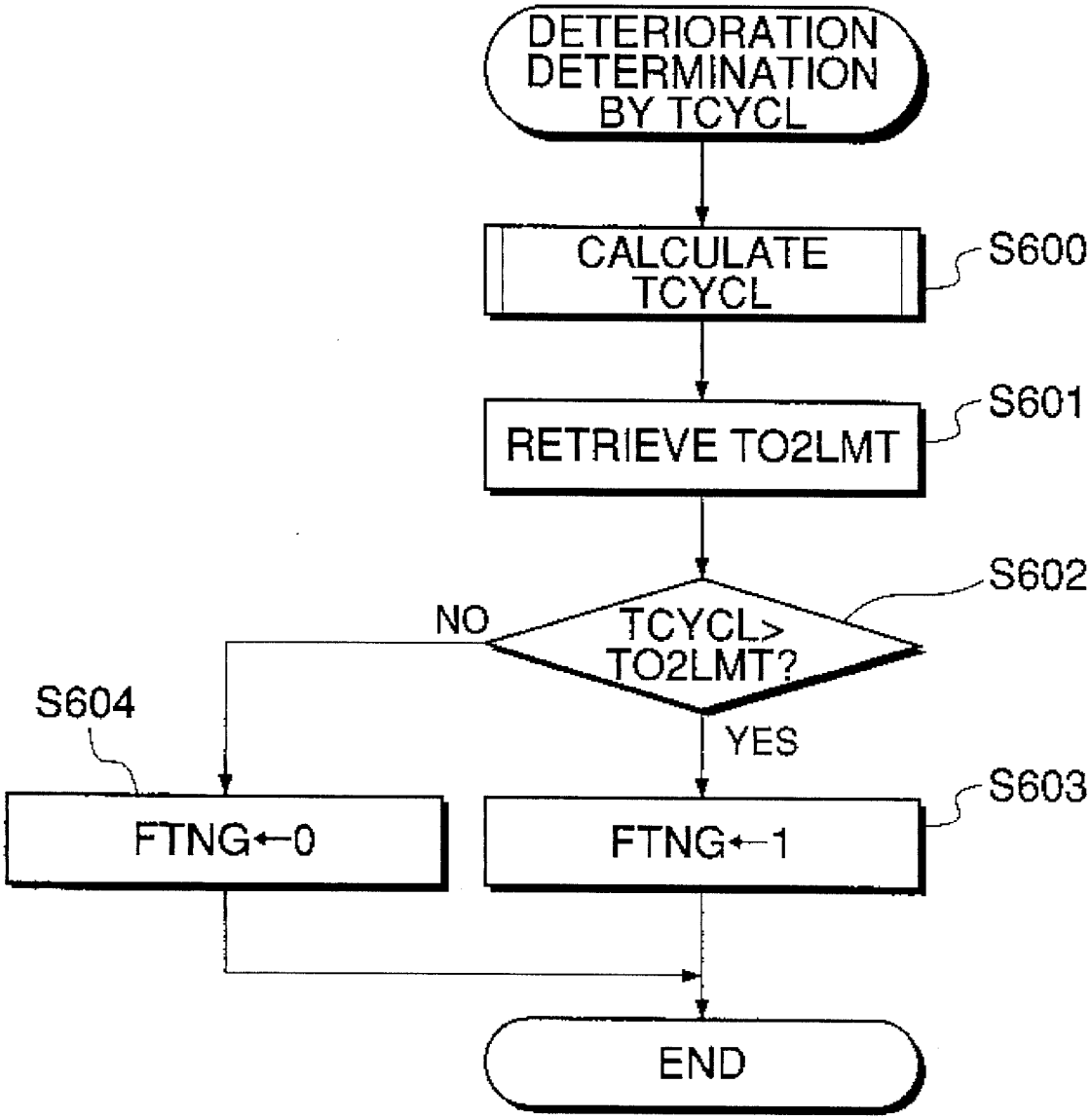
FIG. 6 is a flowchart showing an upstream O2 sensor deterioration-determining routine for determining deterioration of the upstream O2 sensor by the use of an inversion period TCYCL.

Next, description will be made of how deterioration of the upstream O2 sensor 14F is determined by the use of an inversion period TCYCL with reference to FIG. 6 showing an upstream O2 sensor deterioration-determining routine.

First, at a step S600, a TCYCL-calculating subroutine is executed to calculate the inversion period TCYCL with which the output VO2F from the upstream O2 sensor 14F is inverted from the leaner side to the richer side.

Figure 7:
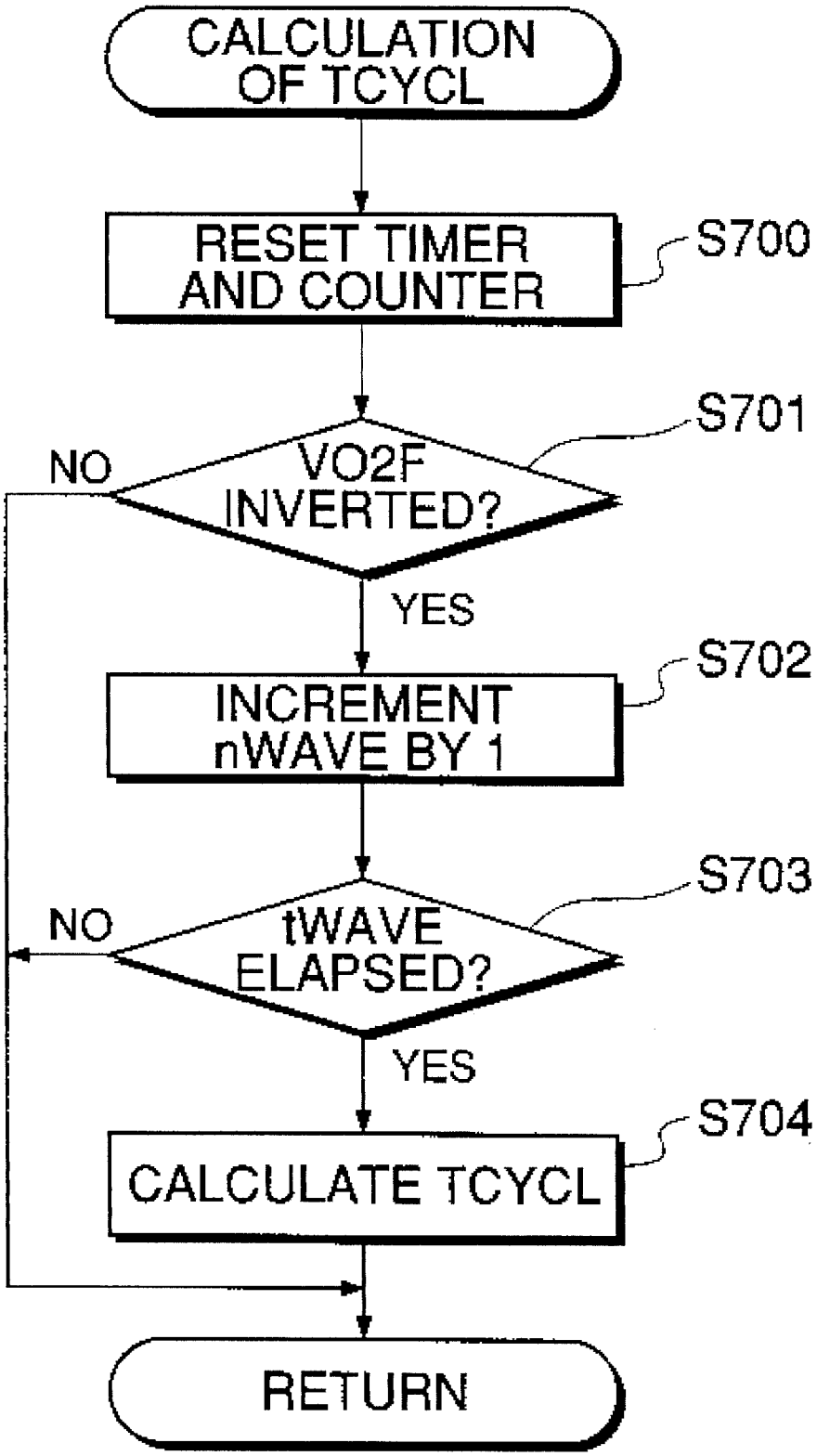
FIG. 7 is a flowchart showing a TCYCL-calculating subroutine for determining the inversion period TCYCL.

FIG. 7 shows the TCYCL-calculating subroutine. In first executing this subroutine, a timer for measuring a time period tWAVE and a counter for counting a number nWAVE of waves of a waveform indicative of the VO2F value are both set to "0" at a step S700. The routine of FIG. 7 is illustrated in a simplified manner. That is, the timer and counter are not reset again after execution of the step S700, before the inversion period TCYCL is calculated at a step S704. Following the step S700, it is determined whether or not the output VO2F from the upstream O2 sensor 14F has been inverted from the leaner side to the richer side or vice versa with respect to the reference value VREFF. If the answer to this question is affirmative (YES), the counter increments the number nWAVE of waves of the output VO2F (i.e., number of times of inversion of the output VO2F) by 1 at a step S702. Then, it is determined at a step S703 whether or not the time period tWAVE having elapsed after starting the calculation of the inversion period TCYCL has reached a predetermined time period (e.g., 10 sec.). If the answer to this question is negative (NO), the subroutine is terminated, and if the answer is affirmative (YES), the inversion period TCYCL is calculated at a step S704 by the use of Equation (6):

$$TCYCL=tWAVE/nWAVE \quad (6)$$

The inversion period TCYCL thus calculated is stored into the ECU 5, followed by terminating the routine.

Referring again to FIG. 6, at a step S601, a deterioration-determining reference value TO2LMT for comparison with the inversion period TCYCL obtained at the step S704 is retrieved from a TO2LMT table according to an intake air amount TF (amount of intake air).

Figure 8:
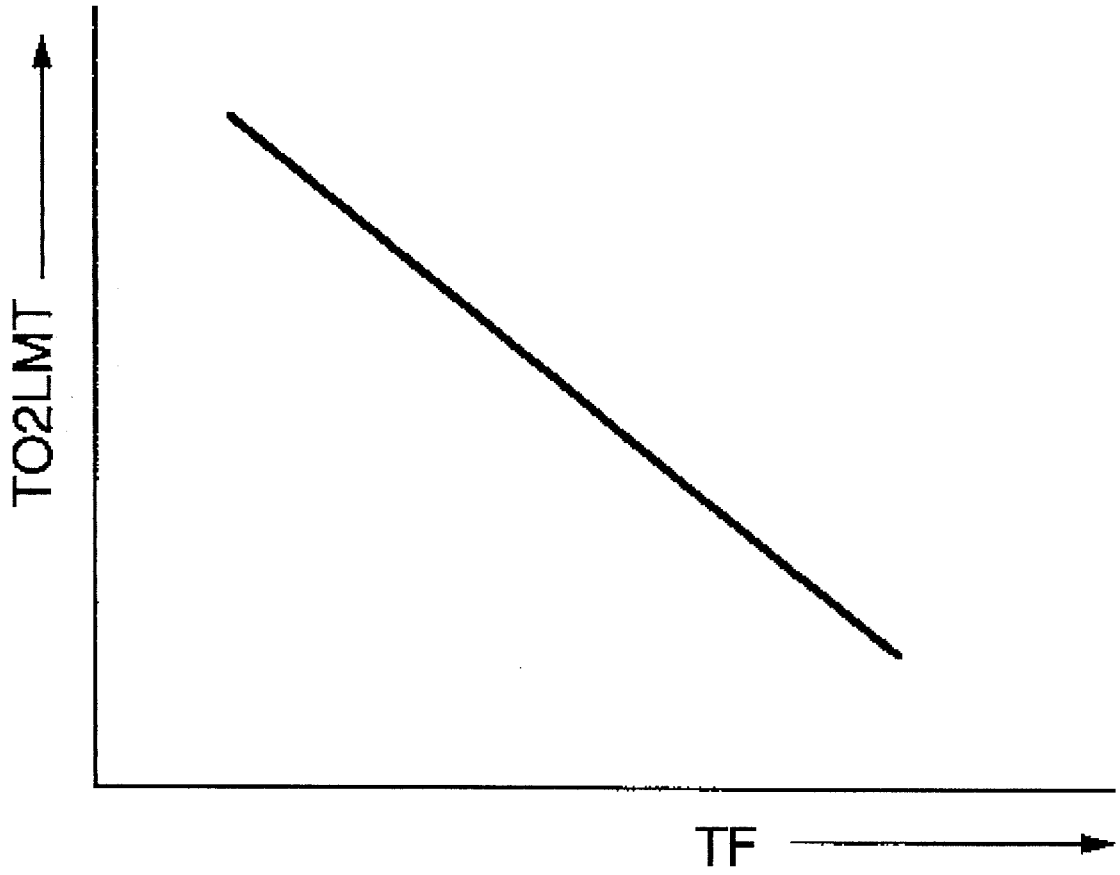
FIG. 8 is a graph showing the relationship between an intake air amount TF and a deterioration-determining reference value TO2LMT.

FIG. 8 shows the relationship between the intake air amount TF and the deterioration-determining reference value TO2LMT, on which the TO2LMT table is based. The larger the intake air amount TF, the shorter the inversion period TCYCLE, and hence according to the TO2LMT table, as the intake air amount TF assumes a large value, the deterioration-determining reference value TO2LMT is set to a smaller value. The intake air amount TF is calculated from the fuel injection period (fuel injection amount) TOUT and the engine rotational speed NE by the use of Equation (7):

$$TF=TOUT\times NE \quad (7)$$

Then, it is determined at a step S602 whether or not the inversion period TCYCL is larger than the deterioration-determining reference value TO2LMT obtained by retrieval from the TO2LMT table. If the answer to this question is affirmative (YES), the program proceeds to a step S603, where a flag FTNG is set to a value of 1, followed by terminating the program, whereas if the answer is negative (NO), the program proceeds to a step S604, where the flag FTNG is set to a value of 0, followed by terminating the program.

Thus, in the present embodiment, even if the inversion period of the output VO2F from the upstream O2 sensor 14 varies with the intake air amount TF, the deterioration-determining reference value TO2LMT is set to a proper value dependent on the intake air amount TF by the use of the TO2LMT table. Therefore, it is possible to carry out determination of deterioration of the upstream O2 sensor even in an ordinary loaded operating condition of the engine in which the intake air amount appreciably varies.

Figure 9:
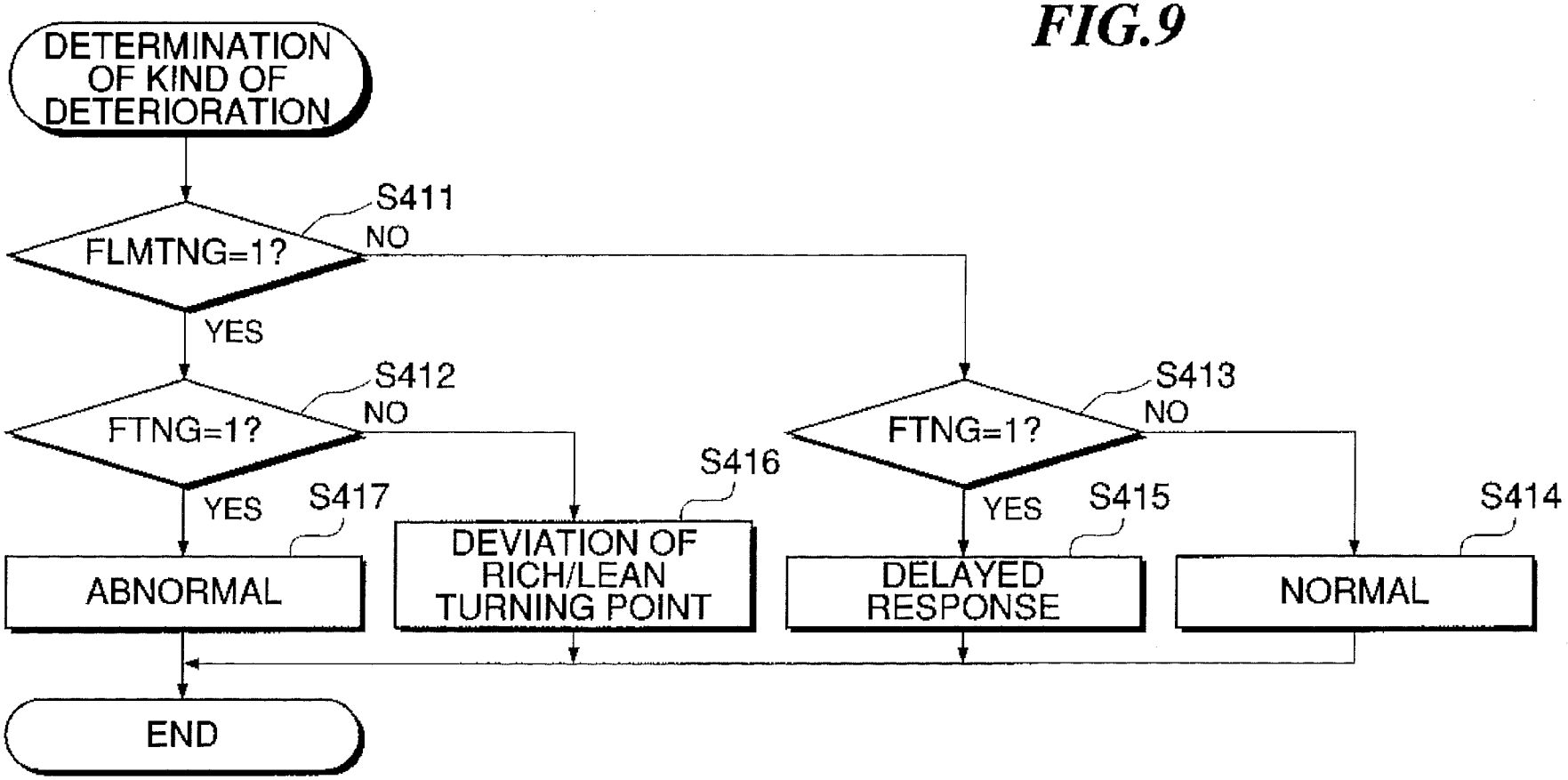
FIG. 9 is a flowchart showing a deterioration kind-determining routine for determining a kind of deterioration of the upstream O2 sensor.

Next, how the kind of deterioration of the upstream O2 sensor 14F is determined will be described with reference to FIG. 9 showing a deterioration kind-determining routine. The flags FTNG and FLMTNG used in the FIG. 9 routine have been set to the value of 1 or 2 as results of the deterioration determinations described hereinabove.

First, steps S411 to S413 are carried out to discriminate a combination of the values of the flags FLMTNG and FTNG. If both the flags are set to 0 (both the answers to the questions of the steps S411 and S413 are negative (NO)), it is determined at a step S414 that the upstream O2 sensor 14F is normally operating. If the flag FLTMG is set to 0 (the answer to the question of the step S411 is negative (NO)), but the flag FLNG is set to the value of 1 (the answer to the question of the step S413 is affirmative (YES)), it is judged at a step S415 that there is a delay in response of the upstream O2 sensor 14F, i.e., the sensor output shows a response lag. If the flag FLMTNG is set to the value of 1 (the answer to the question of the step S411 is affirmative (YES), but the flag FLNG is set to the value of 0 (the answer to the question of the step S412 is negative (NO)), it is determined at a step S416 that the rich/lean turning point is deviated from a point corresponding to the stoichiometric air-fuel ratio to an abnormal degree. Further, if both the flags are set to the value of 1, it is impossible to determine the kind of the deterioration but it is determined at a step S417 that there is some abnormality occurring in the upstream O2 sensor 14F. After determination at any of the steps S414 to S416, the present routine is terminated. Except for the normal case in which both the values of the flags FTNG and FLMTNG are equal to "0", the LED alarm 46 is lighted in one of colors (red, green, or orange) for indication of the kind of deterioration or abnormality. Thus, according to the present routine, it is possible to specify the kind of deterioration of the upstream O2 sensor 14F based on the values of the flags FTNG and FLMTNG.

Figure 10:
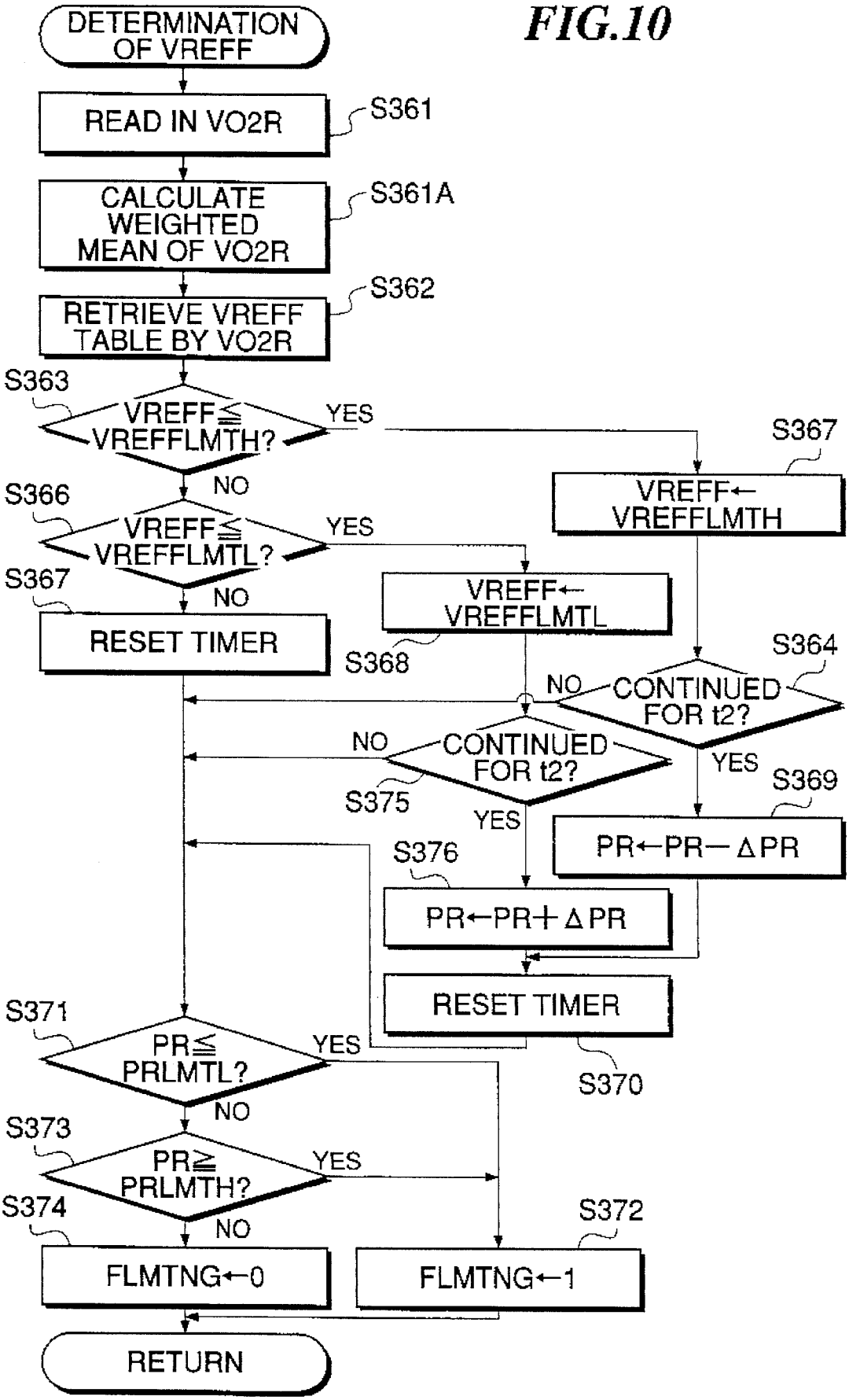
FIG. 10 is a flowchart showing a program for calculating the reference value VREFF executed by a variation of the first embodiment.

Next, a variation of the present embodiment will be described with reference to FIG. 10 showing a variation of the VREF-calculating routine shown in FIG. 3.

First, the present value of the output VO2R from the downstream O2 sensor 14R is read in at a step S361. At the following step S361A, a weighted average value of the output VO2R is calculated from the value read in, and the weighted average value is used at the following step S362 for determining the reference value VREFF for the upstream O2 sensor 14F from the VREFF table. Similarly to the FIG. 3 routine, the reference value VREFF determined is used for comparison with the output VO2F from the upstream O2 sensor 14F at the step S204 in FIG. 2 in execution of the main routine for calculation of the air-fuel ratio coefficient KO2.

Then, it is determined at a step S363 whether or not the reference value VREFF is equal to or higher than the predetermined upper limit value VREFFLMTH. If the answer to this question is affirmative (YES), the reference value VREFF is set to the predetermined upper limit value VREFFLMTH at a step S367. Further, it is determined at a step S364 whether or not this condition has continued longer than the predetermined time period t2 indicated in FIG. 4. If the answer to this question is affirmative (YES), the program proceeds to a step S369, where the proportional term PR for use in changing the air-fuel ratio in the enriching direction is updated by subtracting a decremental value ΔPR therefrom, and then a timer for measuring the predetermined time period t2 is reset at a step S370, followed by the program proceeding to a step S371. If the answer to the question of the step S364 is negative (NO), the program proceeds to the step S371 without updating the proportional term PR and resetting the timer. At the step S371, it is determined whether or not the proportional term PR is equal to or lower than a predetermined lower limit value PRLMT. If the answer to this question is affirmative (YES), the flag FLMTNG is set to a value of 1 at a step S372, followed by terminating the program. If the answer to the question of the step S371 is negative (NO), the program proceeds to a step S373, where it is determined whether or not the proportional term PR is equal to or higher than a predetermined upper limit value PRLMTH. If the answer to this question is affirmative (YES), the program proceeds to the step S372, whereas if the answer is negative (NO), the flag FLMTNG is set to a value of 0 at a step S374, followed by terminating the program.

If the answer to the question of the step S363 is negative (NO), i.e., if VREFF<VREFFLMTH, the program proceeds to a step S366, where it is determined whether or not the reference value VREFF is equal to or lower than the predetermined lower limit value VREFFLMTL. If the answer to this question is question is affirmative (YES), the program proceeds to a step S368, where the reference value VREFF is set to the predetermined lower limit value VREFFLMLTL. Then, it is determined at a step S375, whether or not this condition has continued longer than the predetermined time period t2. If the answer to this question is negative (NO), the program proceeds to the step S371, whereas if the answer is affirmative (YES), the program proceeds to a step S376, where the proportional term PR is updated by adding the incremental value ΔPR thereto, and then the program proceeds to the step S370, where the timer is reset.

If the answer to the question of the step S366 is negative (NO), i.e., if VREFFLMTL<VREFF< VREFFLMTH, the timer for measuring the predetermined time period t2 is reset at a step S377, followed by the program proceeding to the step S371.

Thus, under the condition that the reference value VREFF has continuously been set to the predetermined upper or lower limit value VREFFLMTH or VREFFLMTL over the predetermined time period t2, the proportional term PR is decremented or incremented by the value ΔPR, and when the updated proportional term PR reaches the predetermined upper or lower limit value PRLMTH or PRLMTL, the flag FLMTNG is set to the value of 1. This similarly applies to the proportional term PL for use in changing the air-fuel ratio in the leaning direction.

Next, a second embodiment of the invention will be described. This embodiment is distinguished from the first embodiment described above in that the flag FLMTNG is set by the use of the output VO2R from the downstream O2 sensor 14R itself without using the reference value VREFF. Therefore, an upstream O2 sensor deterioration-determining subroutine is additionally provided, as described hereinbelow, and steps for determining the deterioration are omitted from a VREFF-calculating routine corresponding to the FIG. 3 subroutine. The remainder of the construction is identical to that of the first embodiment.

Figure 11:
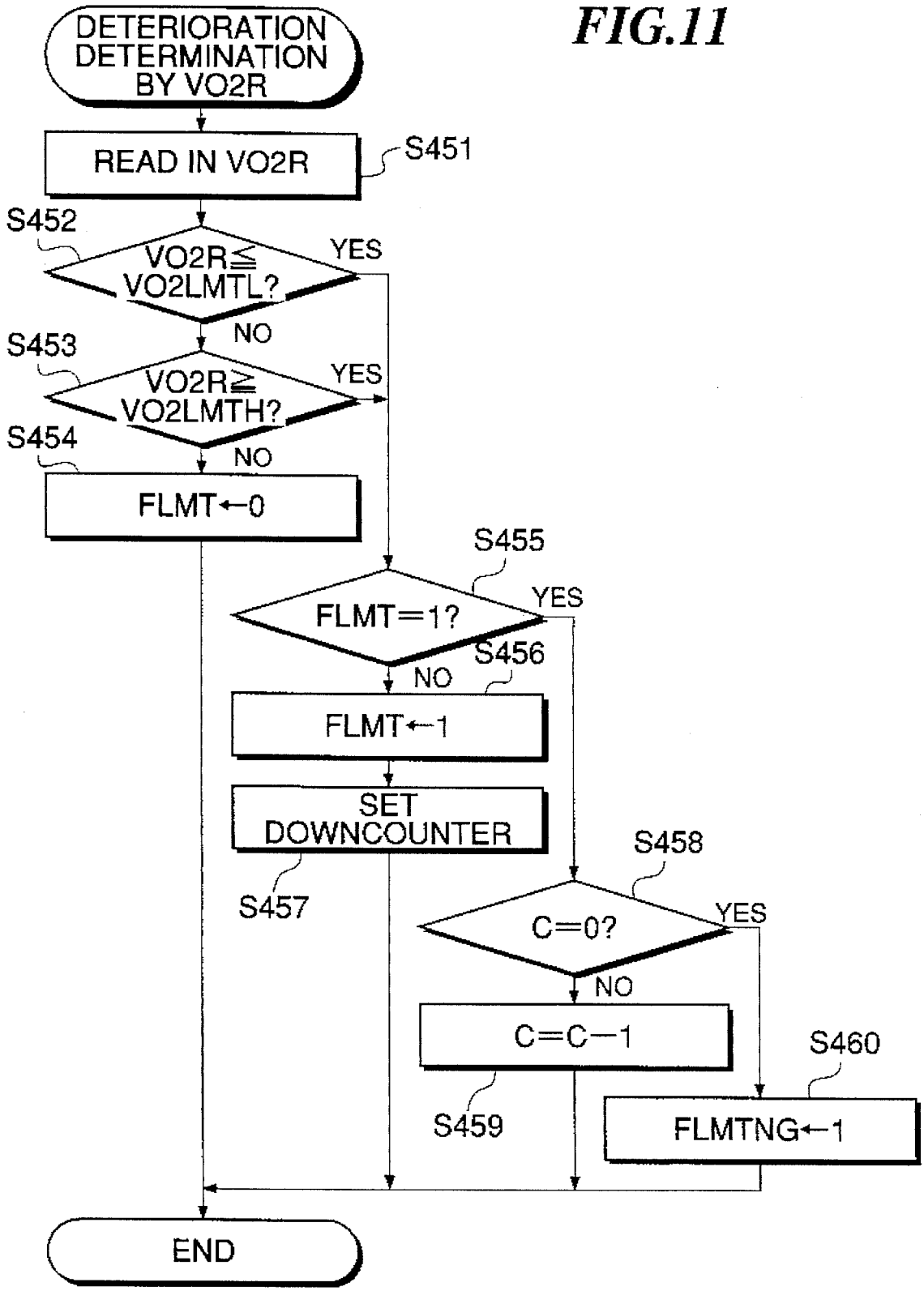
FIG. 11 is a flowchart of an upstream O2 sensor deterioration-determining routine executed by a second embodiment of the invention based on an output VO2R from the downstream O2 sensor.

FIG. 11 shows the upstream O2 sensor deterioration-determining routine based on the output VO2R from the downstream O2 sensor 14R.

First, the output VO2R from the downstream O2 sensor 14R is read in at a step S451. Then, it is determined at a step S452 whether or not the output VO2R read in is equal to or lower than a lower limit value VO2LMTL. If the answer to this question is negative (NO), it is further determined at a step S453 whether or not the output VO2R is equal to or higher than an upper limit value VO2LMTH. If the answer to this question is negative (NO), a flag FLMT is set to a value of 0 at a step S454, followed by terminating the program. If the answer to the question of the step S452 or the answer to the question of the step S453 is affirmative (YES), the program proceeds to a step S455, where it is determined whether or not the flag FLMT has been set to a value of 1. If the answer to this question is negative (NO), the flag FLMT is set to the value of 1 at a step S456, and then the count C of a down counter is set to a predetermined value at a step S457, followed by terminating the program. If the answer to the question of the step S455 is affirmative (YES), the program proceeds to a step S458, where it is determined whether or not the count C of the down counter is equal to 0. If the answer to this question is negative (NO), the count C is decremented by 1 at a step S459, followed by terminating the program, whereas if the answer is affirmative (YES), it is judged that the upstream O2 sensor 14F is deteriorated or aged to an abnormal degree, and the flag FLMTNG is set to a value of 1 at a step S460, followed by terminating the program.

Thus, when the output VO2R from the downstream O2 sensor 14R for detecting the oxygen concentration of exhaust gases falls in a range defined by the upper limit value VO2LMTH and the lower limit value VO2LMTL, the count C of the down counter is reset to 0, and after the output VO2R reaches or exceeds the upper or lower limit value VO2LMTH or VO2LMTL, the count C of the down counter, which is then initially set to the predetermined value, is decremented by 1. If the output VO2R continues to be equal to one of the limits or outside the above-mentioned range for the predetermined time period t3 as indicated in FIG. 4, over which the count C of the down counter is reduced to 0, it is judged that there has occurred deterioration of the upstream O2 sensor 14F and the flag FLMTNG is set to the value of 1.

Also in this embodiment, the kind of deterioration of the upstream O2 sensor is determined by the FIG. 9 routine of the first embodiment, by using the value of the flag FLMTNG determined as above.

As described heretofore, according to the air-fuel ratio control system of the present invention, it is possible to determine the kind of deterioration of the upstream O2 sensor 14F during the air-fuel ratio control, and to notify the kind by lighting the LED alarm 46 in a corresponding manner.

What is claimed is:

1. An air-fuel ratio control system for controlling an air-fuel ratio of a mixture supplied to an internal combustion engine having an exhaust passage, comprising:

a catalytic converter arranged in said exhaust passage for purifying noxious components contained in exhaust gases from said engine;

an upstream exhaust gas component concentration sensor arranged in said exhaust passage at a location upstream of said catalytic converter for detecting concentration of a component contained in said exhaust gases;

a downstream exhaust gas component concentration sensor arranged in said exhaust passage at a location downstream of said catalytic converter for detecting concentration of said component contained in said exhaust gases;

control parameter-setting means for setting a value of a control parameter for use in controlling the air-fuel ratio of said mixture, based on an output from said downstream exhaust gas component concentration sensor;

feedback control means for carrying out feedback control of the air-fuel ratio of said mixture, based on the value of said control parameter set by said control parameter-setting means and an output from said upstream exhaust gas component concentration sensor;

inversion period-detecting means for detecting an inversion period with which said output from said upstream exhaust gas component concentration sensor is inverted from one side to another side or from said another side to said one side with respect to a predetermined level during said feedback control of the air-fuel ratio by said feed back control means;

first determining means for determining whether or not one of said output from said downstream exhaust gas component concentration sensor and the value of said control parameter set by said control parameter-setting means falls within a predetermined range;

second determining means for determining whether or not said inversion period detected by said inversion period-detecting means falls within a predetermined time period; and deterioration-determining means for determining deterioration of said upstream exhaust gas component concentration sensor, based on results of determinations by said first determining means and said second determining means.

2. An air-fuel ratio control system according to claim 1, wherein said deterioration-determining means determines that said upstream exhaust gas component concentration sensor suffers from a deterioration of a delay in response, when said first determining means determines that said one of said output from said downstream exhaust gas component concentration sensor and the value of said control parameter falls within said predetermined range, and at the same time said second determining means determines that said inversion period is longer than said predetermined time period.

3. An air-fuel ratio control system according to claim 1, wherein said deterioration-determining means determines that said upstream exhaust gas component concentration sensor suffers from a deterioration that a point of inversion of said output from said upstream exhaust gas component concentration sensor deviates from a point corresponding to a stoichiometric air-fuel ratio, when said first determining means determines that said one of said output from said downstream exhaust gas component concentration sensor and the value of said control parameter falls outside said predetermined range, and at the same time said second determining means determines that said inversion period falls within said predetermined time period.

4. An air-fuel ratio control system according to claim 3, wherein said first determining means includes time-measuring means for measuring a time period over which said one of said output from said upstream exhaust gas component concentration sensor and the value of said control parameter set by said control parameter-setting means continues to lie outside said predetermined range, said deterioration-determining means determining that said upstream exhaust gas component concentration sensor suffers from said deterioration that said point of inversion of said output from said upstream exhaust gas component concentration sensor deviates from said point corresponding to said stoichiometric air-fuel ratio, when said time period measured by said time measuring means reaches a predetermined time period, and at the same time said second determining means determines that said inversion period falls within said predetermined time period.

5. An air-fuel ratio control system according to claim 3, wherein said control parameter is a reference value used in said feedback control of the air-fuel ratio for comparison with said output from said upstream exhaust gas component concentration sensor.

6. An air-fuel ratio control system according to claim 4, wherein said control parameter is a reference value used in said feedback control of the air-fuel ratio for comparison with said output from said upstream exhaust gas component concentration sensor.

7. An air-fuel ratio control system according to claim 3, wherein said control parameter is a proportional term used in said feedback control of the air-fuel ratio.

8. An air-fuel ratio control system according to claim 7, wherein said control parameter-setting means includes reference value-setting means for setting a reference value used in said feedback control of the air-fuel ratio for comparison with said output from said upstream exhaust gas component concentration sensor, based on said output from said downstream exhaust gas component concentration sensor, time-measuring means for measuring a time period over which said reference value falls outside a predetermined range, and changing means for incrementing or decrementing said proportional term by a predetermined value whenever said time period measured by said time-measuring means reaches a predetermined time period.

* * * * *